US009902149B2

(12) United States Patent
Misawa

(10) Patent No.: US 9,902,149 B2
(45) Date of Patent: Feb. 27, 2018

(54) LIQUID INJECTION DEVICE AND INKJET RECORDING DEVICE INCLUDING THE SAME

(71) Applicant: Roland DG Corporation, Hamamatsu-shi, Shizuoka (JP)

(72) Inventor: Keisuke Misawa, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/485,251

(22) Filed: Apr. 12, 2017

(65) Prior Publication Data

US 2017/0297329 A1 Oct. 19, 2017

(30) Foreign Application Priority Data

Apr. 13, 2016 (JP) ..... 2016-080023

(51) Int. Cl.
*B41J 2/045* (2006.01)

(52) U.S. Cl.
CPC ..... *B41J 2/04563* (2013.01); *B41J 2/04541* (2013.01); *B41J 2/04581* (2013.01)

(58) Field of Classification Search
CPC . B41J 2/04563; B41J 2/04541; B41J 2/04581
See application file for complete search history.

(56) References Cited

U.S. PATENT DOCUMENTS 7,510,255 B2 * 3/2009 Tamura ..... B41J 2/04541 347/17
8,562,094 B2 * 10/2013 Ozawa ..... B41J 2/04528 347/10
2011/0316915 A1 * 12/2011 Matsushita ..... B41J 2/04553 347/10

FOREIGN PATENT DOCUMENTS

JP 2012-125998 A 7/2012

* cited by examiner

*Primary Examiner* — Lamson Nguyen
(74) *Attorney, Agent, or Firm* — Keating & Bennett, LLP

(57) ABSTRACT

A liquid injection device includes a driving signal correction circuit correcting a reference driving signal based on a temperature detected by a temperature sensor. The driving signal correction circuit includes a first correction circuit that corrects injection pulses excluding a liquid drop injection speed-controlling injection pulse when the temperature detected by the temperature sensor is lower than or equal to a predetermined reference temperature, and a second correction circuit that corrects all of the injection pulses when the temperature detected by the temperature sensor is higher than the predetermined reference temperature.

7 Claims, 6 Drawing Sheets

LIQUID INJECTION DEVICE AND INKJET RECORDING DEVICE INCLUDING THE SAME

CROSS REFERENCE TO RELATED APPLICATIONS

This application claims the benefit of priority to Japanese Patent Application No. 2016-080023 filed on Apr. 13, 2016. The entire contents of this application are hereby incorporated herein by reference.

BACKGROUND OF THE INVENTION

1. Field of the Invention

The present invention relates to a liquid injection device and an inkjet recording device including the same, and more specifically, to a technology that controls liquid injection using a so-called multi-dot system.

2. Description of the Related Art

Conventionally, a liquid injection device including a pressure chamber storing a liquid, a vibration plate demarcating a portion of the pressure chamber, a pressure generator coupled with the vibration plate, a nozzle in communication with the pressure chamber to inject an ink drop, and a controller supplying a driving signal to the pressure generator to drive the pressure generator is known. Such a liquid injection device is provided in, for example, an inkjet recording device injecting ink as a liquid.

In an inkjet recording device including the above-described liquid injection device, when the controller supplies a pulse signal to the pressure generator, the pressure generator is deformed. In accordance therewith, the vibration plate is deformed. As a result, a capacity of the pressure chamber is increased or decreased, and the pressure of ink in the pressure chamber is changed. In accordance with such a change in the pressure, the ink in the pressure chamber is injected from the nozzle. The injected ink becomes an ink drop and lands on a recording medium supported by a platen. As a result, one dot (corresponding to one pixel) is formed on the recording medium. A great number of such dots are formed on the recording paper sheet, so that an image or the like is formed.

It is effective to adjust the size of the dot from the point of view of forming a high-quality image on the recording medium. However, with the inkjet recording device, there is a limit on the amount of ink which can be accurately and reliably injected by one injection pulse. Namely, it is difficult to form a dot of any of various sizes with one injection pulse. In such a situation, the size of the dot is adjusted by a so-called multi-dot system, by which a driving waveform including a plurality of injection pulses is generated in one liquid drop injection period that is preset as a time period for forming one dot.

In a liquid injection device as described above, ink has a viscosity thereof changed in accordance the environmental temperature or the like. For example, when the temperature of the ink is increased, the ink has a fluidity thereof increased and thus becomes more easy to be injected. As a result, the injection speed of the ink may be changed, so that the position at which the ink drop lands is shifted, or the size of the dot may be changed. As a result, the darkness of the image may be changed. Conventionally, in order to avoid such an inconvenience, the driving voltage of the injection pulse is changed in accordance with the temperature of the ink, so that a dot of a predetermined size is formed accurately and reliably.

For example, Japanese Laid-Open Patent Publication No. 2012-125998 discloses, in FIG. 7, a driving signal Pv includes seven injection pulses in a time-series manner in one liquid drop injection period. In Japanese Laid-Open Patent Publication No. 2012-125998, the driving voltages of all the seven injection pulses included in the driving signal Pv are changed in accordance with the temperature of the ink to generate a driving waveform for temperature correction, and the driving waveform is supplied to the pressure generator (see FIG. 8 of Japanese Laid-Open Patent Publication No. 2012-125998).

However, studies performed by the present inventor discovered the following. When, for example, the voltages of all of a plurality of injection pulses are changed in the case where the temperature of the ink is low, the injection stability may be decreased at the time of formation of a large dot. Specifically, the ink is attached to an area in the vicinity of the opening of the nozzle, and thus the distribution of wettability is made non-uniform. When this occurs, the track of an ink drop injected next may be shifted from the proper track, or ink mist may be easily generated. Such problems are not negligible for a large printer for industrial use, which forms a larger dot at higher speed than a home-use printer.

SUMMARY OF THE INVENTION

Preferred embodiments of the present invention provide a liquid injection device capable of injecting a liquid drop accurately and reliably in a wide temperature range. Other preferred embodiments of the present invention provide an inkjet recording device including such a liquid injection device.

According to a preferred embodiment of the present invention, a liquid injection device includes a hollow case accommodating a pressure chamber storing a liquid; a vibration plate provided in the case and demarcating a portion of the pressure chamber; a pressure generator coupled with the vibration plate, the pressure generator expanding or contracting the pressure chamber upon receipt of an electric signal; a nozzle provided in the case and in communication with the pressure chamber; a temperature sensor detecting a temperature of the liquid; a driving signal storage circuit storing a reference driving signal including at least four injection pulses, causing the liquid to be injected from the nozzle, in one liquid drop injection period; a correction coefficient calculation circuit calculating a temperature correction coefficient based on the temperature detected by the temperature sensor; a driving signal correction circuit correcting the reference driving signal with the temperature correction coefficient; and a driving signal supply circuit supplying the reference driving signal corrected by the driving signal correction circuit to the pressure generator. The at least four injection pulses included in the reference driving signal include a liquid drop injection speed-controlling injection pulse started at a timing that is about $(n+(1/2))\times Tc$ after start of an immediately previous injection pulse in a time-series manner (n is a natural number, and Tc is a Helmholtz characteristic vibration period of the pressure chamber). The driving signal correction circuit includes a first correction circuit correcting the injection pulses excluding the liquid drop injection speed-controlling injection pulse among the at least four injection pulses when the temperature detected by the temperature sensor is lower than or equal to a predetermined reference temperature, and a second correction circuit correcting all of the at least four injection pulses when the temperature detected by the temperature sensor is higher than the predetermined reference temperature.

With the above-described liquid injection device, even when the temperature of the liquid is low, the above-described inconveniences are significantly reduced or eliminated, so that the injection stability is improved. Therefore, the liquid injection device injects a liquid in a preferable manner in a wide temperature range from a low temperature to a high temperature, and forms a dot of a predetermined size with high precision.

In another aspect preferred embodiment of the present invention, an inkjet recording device including the above-described liquid injection device is provided. The inkjet recording device forms a dot of a large size accurately and reliably by a multi-dot system. Therefore, for example, the variance in the dot diameter is decreased to improve the image quality. In addition, stains on the recording medium or the device itself caused by ink mist or the like are decreased.

A liquid injection device according to a preferred embodiment of the present invention injects a liquid drop of a predetermined size accurately and reliably in a wide temperature range from a low temperature to a high temperature by a multi-dot system. Therefore, the injection stability is improved at the time of formation of a large liquid drop.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, liquid injection devices and inkjet recording devices including the same according to preferred embodiments of the present invention will be described with reference to the drawings. The preferred embodiments described herein do not limit the present invention in any way. Components or portions having the same function will bear the same reference signs, and overlapping descriptions will be omitted or simplified.

Figure 1:
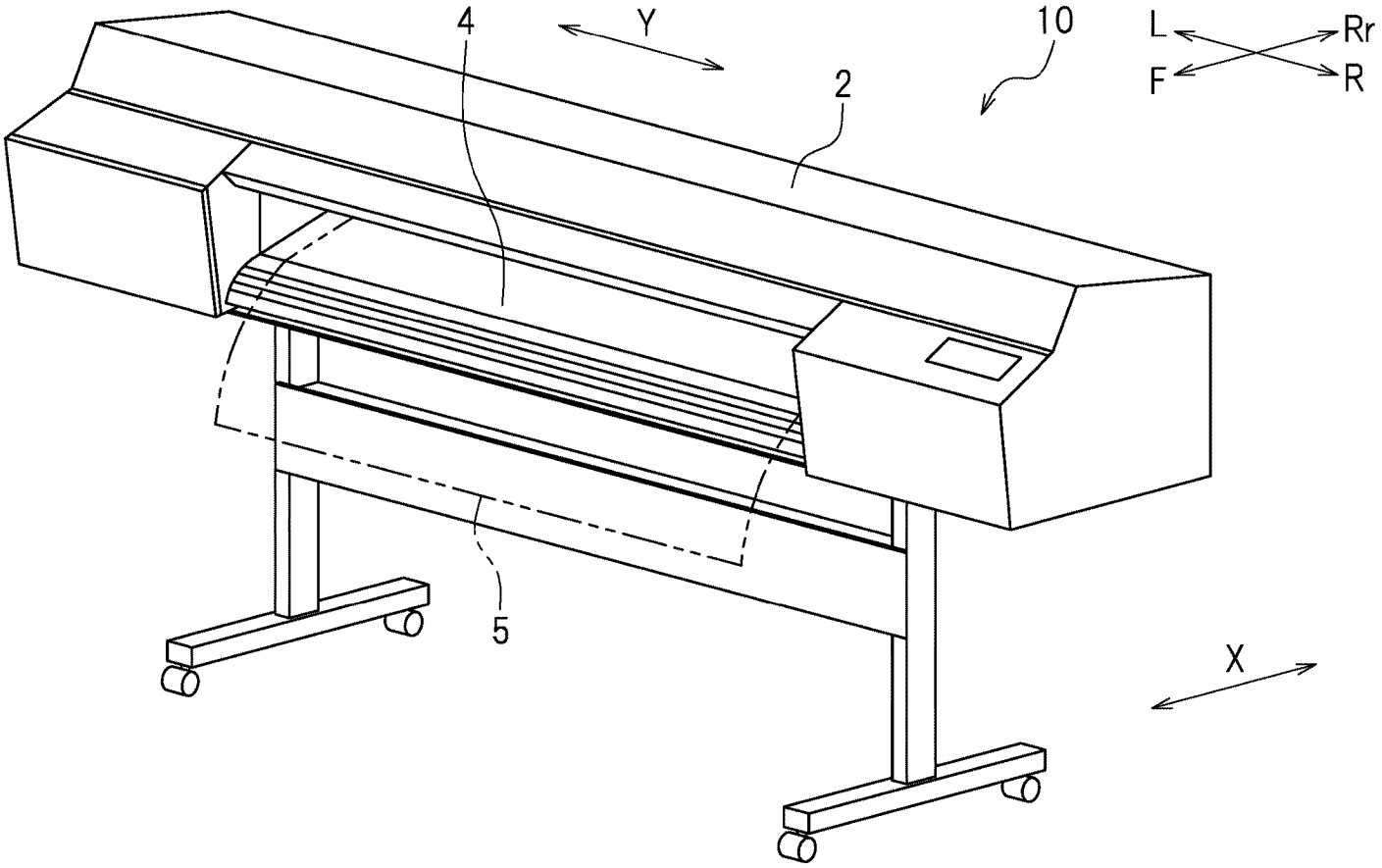
FIG. 1 is a perspective view of an inkjet printer according to a preferred embodiment of the present invention.
Figure 2:
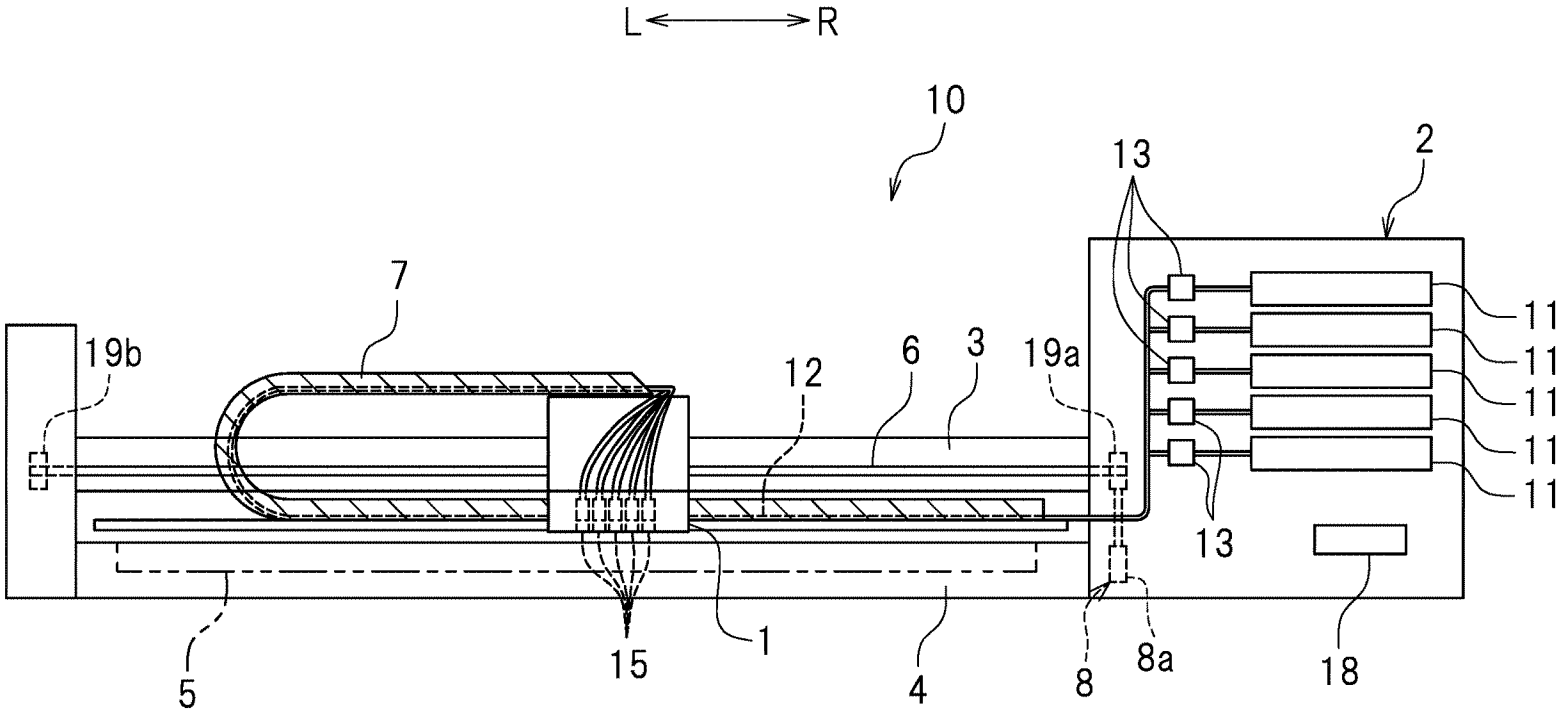
FIG. 2 is a front view of a portion of the inkjet printer of FIG. 1.

First, an inkjet recording device will be described. FIG. 1 is a perspective view of a large inkjet printer (hereinafter, referred to as a "printer") 10 according to a preferred embodiment of the present invention. FIG. 2 is a front view showing a portion of the printer 10. The printer 10 is an example of an inkjet recording device. In FIG. 1 and FIG. 2, the letters "L" and "R" respectively refer to left and right. The letters "F" and "Rr" respectively refer to front and rear. It should be noted that these directions are defined merely for the sake of convenience, and do not limit the manner of installation of the inkjet printer 10 in any way.

The inkjet printer 10 is to perform printing on a recording paper sheet 5. The recording paper sheet 5 is an example of a recording medium, and is an example of target to which ink is to be injected. The "recording medium" encompasses recording mediums formed of paper including plain paper and the like, resin materials including polyvinyl chloride (PVC), polyester and the like, and various other materials including aluminum, iron, wood and the like.

The printer 10 includes a casing 2, and a guide rail 3 located in the casing 2. The guide rail 3 extends in a left-right direction. The guide rail 3 is in engagement with a carriage 1 provided with ink injection heads 15 injecting ink. The carriage 1 moves reciprocally in the left-right direction (scanning direction) along the guide rail 3 by a carriage moving mechanism 8. The carriage moving mechanism 8 includes pulleys 19*a* and 19*b* provided at a right end and a left end of the guide rail 3. The pulley 19*a* is coupled with a carriage motor 8*a*. The pulley 19*a* is driven by the carriage motor 8*a*. An endless belt 6 extends along, and between, the pulleys 19*a* and 19*b*. The carriage 1 is secured to the endless belt 6. When the pulleys 19*a* and 19*b* are rotated and thus the belt 6 runs, the carriage 1 moves in the left-right direction.

The printer 10 is a large inkjet printer, and is larger than, for example, a table-top printer for home use. The scanning speed of the carriage 1 may preferably be occasionally set to be relatively high from the point of view of increasing the throughput although the scanning speed is set also in consideration of resolution. For example, the scanning speed may be preferably set to about 600 mm/s to about 900 mm/s when the driving frequency is about 14 kHz. For higher-speed operation, the scanning speed may be set to about 1000 mm/s or greater, for example, about 1100 mm/s to about 1200 mm/s, when the driving frequency is about 20 kHz. In such a case, the interval between injections of ink drops is significantly short. Therefore, the technology disclosed herein is especially effective for the printer 10.

The recording paper sheet 5 is transported in a paper feeding direction by a paper feeding mechanism (not shown). In this example, the paper feeding direction is a front-rear direction (represented by arrow X in FIG. 1). The casing 2 accommodates a platen 4 supporting the recording paper sheet 5. The platen 4 includes a grid roller (not shown). A pinch roller (not shown) is provided above the grid roller. The grid roller is coupled with a feed motor (not shown). The grid roller is driven to rotate by the feed motor. When the grid roller is rotated in a state where the recording paper sheet 5 is held between the grid roller and the pinch roller, the recording paper sheet 5 is transported in the front-rear direction.

The printer 10 includes a plurality of ink cartridges 11. The plurality of ink cartridges 11 respectively store ink of different colors. In this preferred embodiment, the printer 10 preferably includes five ink cartridges 11 storing cyan ink, magenta ink, yellow ink, black ink and white ink, for example. The ink cartridges 11 are detachably accommodated in the casing 2.

The printer 10 includes ink injection heads 15 respectively provided for the ink cartridges 11 for different colors. The ink injection head 15 and the ink cartridge 11 for each of colors are connected with each other via an ink supply path 12. The ink supply path 12 is an ink flow path usable to supply the ink from the ink cartridge 11 to the ink injection head 15. The ink supply path 12 is, for example, a flexible tube. A pump 13 is provided on the ink supply path 12. The pump 13 is not absolutely necessary, and may be omitted. The ink injection heads 15 are mounted on the carriage 1 and reciprocally move in the left-right direction. By contrast, the ink cartridges 11 are not mounted on the carriage 1 and do not reciprocally move in the left-right direction. A portion of the ink supply path 12 extends in the left-right direction and is covered with a cable protection and guide device 7 so as not to be broken even when the carriage 1 moves in the left-right direction.

The ink injection heads 15 each inject the ink toward the recording paper sheet 5 to form a dot of the ink on the recording paper sheet 5. A great number of such dots are arrayed to form an image or the like. Each ink injection head 15 includes a plurality of nozzles 25 (see FIG. 3) usable to inject the ink. The plurality of nozzles 25 are provided in a surface of the injection head 15 that faces the recording paper sheet 5 (in this preferred embodiment, on a bottom surface of the ink injection head 15). The plurality of nozzles 25 are arrayed at a predetermined pitch corresponding to the dot formation density (for example, arrayed at 360 dpi).

Figure 3:
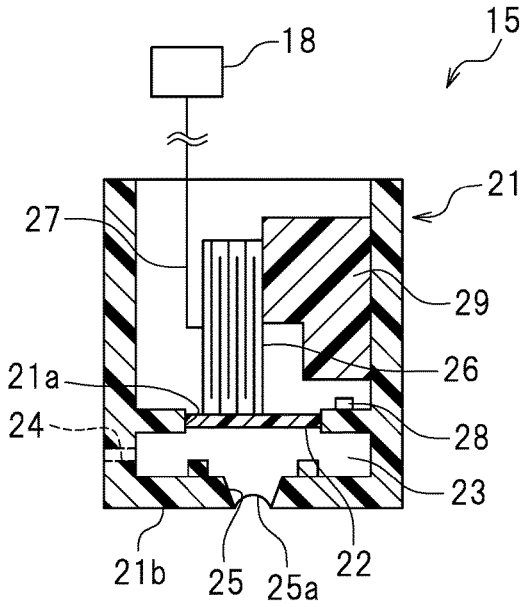
FIG. 3 is a cross-sectional view of a portion of an injection head.

FIG. 3 is a partial cross-sectional view of one nozzle 25 and the vicinity thereof of the ink injection head 15. As shown in FIG. 3, the ink injection head 15 includes a hollow case 21 provided with an opening 21*a*, and a vibration plate 22 attached to the case 21 so as to cover the opening 21*a*. The vibration plate 22 demarcates a portion of the pressure chamber 23. The vibration plate 22 defines, together with the case 21, a portion of a pressure chamber 23 storing the ink. The vibration plate 22 is elastically deformable to the inside and the outside of the pressure chamber 23. Therein, the term "inside" refers to the upper side with respect to the vibration plate 22 in FIG. 3, and the term "outside" refers to the lower side with respect to the vibration plate 22 in FIG. 3. The vibration plate 22 is deformable to increase or decrease the capacity of the pressure chamber 23. The vibration plate 22 is typically a resin film.

A side wall of the case 21 (left wall in FIG. 3) is provided with an ink inlet 24. The ink inlet 24 allows the ink to flow into the case 21. The ink inlet 24 merely needs to be in communication with the pressure chamber 23, and there is no limitation on the position of the ink inlet 24. The ink inlet 24 is in communication with the ink cartridge 11. The pressure chamber 23 is supplied with the ink from the ink cartridge 11 via the ink inlet 24, and stores the ink. The viscosity of the ink in the pressure chamber 23 may preferably be about 1 mPa·s to about 50 mPa·s, for example, about 5 mPa·s to about 10 mPa·s in a temperature range of, for example, about 20° C. to about 40° C. from the point of view of improving the injection stability and thus realizing high-quality printing. The nozzles 25 each inject an ink drop toward the recording paper sheet 5. The nozzles 25 are preferably located in a bottom surface 21*b* of the case 21. The nozzles 25 each have a diameter of, for example, about 25 μm (tolerance: about +1.5 μm/−1.0 μm). A liquid surface (free surface) of the ink in each of the nozzles 25 forms a meniscus 25*a*.

A thermistor 28 is provided on an inner wall of the case 21 (right wall in FIG. 3). The thermistor 28 is an example of temperature sensor detecting the temperature of the ink injection head 15. In this example, the thermistor 28 detects the temperature of the inner surface of the case 21 and approximates the temperature of the inner surface to the temperature of the ink. The thermistor 28 is, for example, a diode sensor, a metal thin film sensor or the like. The thermistor 28 may be provided, for example, on an outer wall of the case 21, in the ink supply path 12 or the like. The temperature sensor may be a thermocouple capable of directly detecting the temperature of the ink. The temperature sensor may be provided in the carriage 1 or the casing 2 to detect the temperature of the environment in which the printer 10 is provided. In this case, the temperature of the ink may be extrapolated from the detected temperature of the environment.

The pressure chamber 23 has the Helmholtz characteristic vibration period Tc. The Helmholtz characteristic vibration period Tc is uniquely specified by the material, size, shape or location of each of components defining the pressure chamber 23, for example, the case 21 and the vibration plate 22, the opening area size of the nozzle 25, properties (e.g., viscosity) of the ink, and the like. The Helmholtz characteristic vibration period Tc is a vibration period characteristic to the ink injection head 15 at the time of ink injection. The Helmholtz characteristic vibration period Tc is, for example, a vibration period of several microseconds to several ten microseconds. After an ink drop is injected, the pressure chamber 23 has a residual vibration having such a vibration period.

A piezoelectric element 26 is in contact with a surface of the vibration plate 22 opposite to the pressure chamber 23. An end of the piezoelectric element 26 is secured to a secured member 29. The piezoelectric element 26 is an example of a pressure generator. The piezoelectric element 26 is connected with the controller 18 via a flexible cable 27. The piezoelectric element 26 is supplied with an electric signal (driving signal) via the flexible cable 27. In this preferred embodiment, the piezoelectric element 26 is a stacked body including a piezoelectric material layer and a conductive layer stacked alternately. The piezoelectric element 26 is extended or contracted upon receipt of the driving signal supplied thereto by the controller 18 to act to elastically deform the vibration plate 22 to the inside or to the outside of the pressure chamber 23. In this example, the piezoelectric element 26 is a piezoelectric transducer (PZT) of a longitudinal vibration mode. The PZT of the longitudinal vibration mode is extendable in the stacking direction, and, for example, is contracted when being discharged and is extended when being charged. There is no specific limitation on the type of the piezoelectric element 26. The pressure actuator is not limited to the piezoelectric element 26.

In the ink injection head 15 having the above-described structure, the piezoelectric element 26 is contracted by, for example, a decrease in the potential thereof from an intermediate potential. When this occurs, the vibration plate 22 follows this contraction to be elastically deformed to the outside of the pressure chamber 23 from an initial position, and thus the pressure chamber 23 is expanded. The expression that the "pressure chamber 23 is expanded" refers to that the capacity of the pressure chamber 23 is increased by the deformation of the vibration plate 22. Next, the potential of the piezoelectric element 26 is increased to extend the piezoelectric element 26 in the stacking direction. As a result, the vibration plate 22 is elastically deformed to the inside of the pressure chamber 23, and thus the pressure chamber 23 is contracted. The expression that the "pressure chamber 23 is contracted" refers to the capacity of the pressure chamber 23 being decreased by the deformation of the vibration plate 22. Such expansion/contraction of the pressure chamber 23 changes the pressure inside the pressure chamber 23. Such a change in the pressure inside the pressure chamber 23 pressurizes the ink in the pressure chamber 23, and the ink is injected from the nozzle 25. Then, the potential of the piezoelectric element 26 is returned to the intermediate potential, so that the vibration plate 22 returns to the initial position and the pressure chamber 23 is expanded. At this point, the ink flows into the pressure chamber 23 via the ink inlet 24.

The controller 18 is communicably connected with the carriage motor 8*a* of the carriage moving mechanism 8, the feed motor of the paper feeding mechanism, the pump 13, and the ink injection head 15. The controller 18 is configured or programmed to control operations of these components. The controller 18 is typically a computer, for example. The controller 18 includes, for example, an interface (I/F) receiving printing data or the like from an external device such as a host computer or the like, a central processing unit (CPU) executing a command of a control program or programs, a ROM storing the program(s) to be executed by the CPU, a RAM usable as a working area in which the program is developed, and a storage device (storage medium) such as a memory or the like storing the above-described program and various other types of data.

Figure 4:
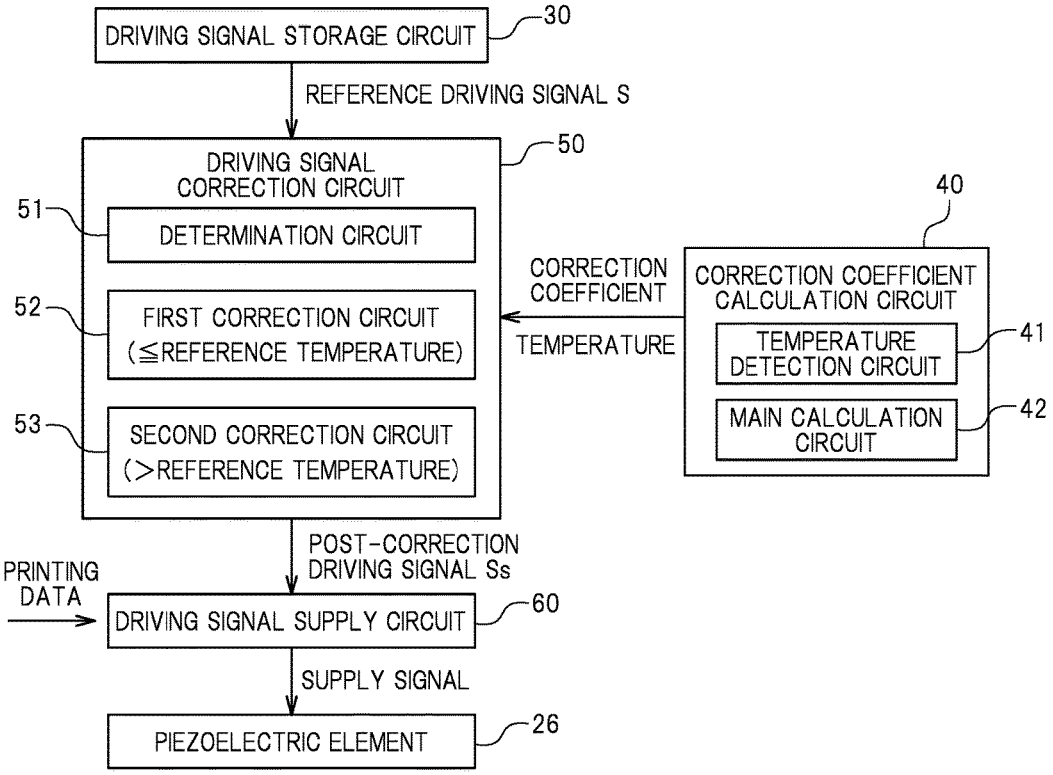
FIG. 4 is a block diagram showing a structure of a portion of a controller.

FIG. 4 is a block diagram showing a structure of a portion of the controller 18. As shown in FIG. 4, the controller 18 includes a driving signal storage circuit 30 storing a reference driving signal S, a correction coefficient calculation circuit 40 calculating a temperature correction coefficient from the temperature of the ink detected by the thermistor 28, a driving signal correction circuit 50 correcting the reference driving signal S, stored by the driving signal storage circuit 30, with the temperature correction coefficient calculated by the correction coefficient calculation circuit 40 and generating a post-correction driving signal Ss, and a driving signal supply circuit 60 supplying a portion of, or the entirety of, the post-correction driving signal Ss, generated by the correction performed by the driving signal correction circuit 50, to the piezoelectric element 26 of the ink injection head 15. In the following description, an electric signal supplied from the driving signal supply circuit 60 to the piezoelectric element 26 may be referred to as a "supply signal".

The driving signal storage circuit 30 is mutually communicable with the driving signal correction circuit 50. The driving signal storage circuit 30 stores the reference driving signal S including at least four injection pulses in one liquid drop injection period Pa. The injection pulses are each a driving pulse causing an ink drop to be injected from the nozzle 25 in the ink injection head 15. The details of the reference driving signal S will be described below. There is no limitation on the hardware configuration of the driving signal storage circuit 30. The hardware configuration may be the same as a conventional configuration.

The correction coefficient calculation circuit 40 is mutually communicable with the driving signal correction circuit 50. The correction coefficient calculation circuit 40 includes, for example, a temperature detection circuit 41 and a main calculation circuit 42. The temperature detection circuit 41 drives the thermistor 28 to detect the temperature of the ink. The main calculation circuit 42 calculates a temperature correction coefficient in consideration of the viscosity and the fluidity of the ink based on the temperature of the ink detected by the temperature detection circuit 41.

The driving signal correction circuit 50 is mutually communicable with each of the driving signal storage circuit 30, the correction coefficient calculation circuit 40 and the driving signal supply circuit 60. The driving signal correction circuit 50 includes, for example, a determination circuit 51, a first correction circuit 52 and a second correction circuit 53. The determination circuit 51 determines whether the temperature of the ink detected by the temperature detection circuit 41 is no higher than a predefined reference temperature. In the case where the temperature of the ink is determined by the temperature detection circuit 41 as being lower than, or equal to, the predetermined reference temperature, the first correction circuit 52 corrects only a portion of the injection pulses included in the reference driving signal S with the temperature correction coefficient. In the case where the temperature of the ink is determined by the temperature detection circuit 41 as being higher than the reference temperature, the second correction circuit 53 corrects all the injection pulses included in the reference driving signal S with the temperature correction coefficient.

The driving signal supply circuit 60 is mutually communicable with the driving signal correction circuit 50. The driving signal supply circuit 60 selects a portion of, or all of, the injection pulses included in a post-correction driving signal Ss, generated by the driving signal correction circuit 50, in accordance with the size of the dot. Then, the driving signal supply circuit 60 generates a supply signal. The driving signal supply circuit 60 supplies the generated supply signal to the piezoelectric element 26 of the ink injection head 15. There is no limitation on the hardware configuration of the driving signal supply circuit 60. The hardware configuration may be the same as a conventional configuration.

Now, the reference driving signal S generated by the driving signal storage circuit 30 will be described. The reference driving signal S includes at least four driving pulses (injection pulses), typically four to 10 driving pulses, for example, four to six driving pulses, each causing an ink drop to be injected from the nozzle 25 during a unit period (one liquid drop injection period), which is a time period for forming one dot. An injection pulse is a waveform typically including a waveform component by which the potential is decreased to expand the pressure chamber 23, a waveform component by which the decreased potential is maintained at the decreased level to keep the pressure chamber 23 expanded, and a waveform component by which the maintained potential is increased to contract the pressure chamber 23. The reference driving signal S may include, before or after each injection pulse in a time-series manner, a driving pulse causing the pressure chamber 23 in the ink injection head 15 to expand or contract to such a degree that an ink drop is not injected from the nozzle 25 (namely, the reference driving signal S may include a non-injection driving pulse).

In one preferred embodiment of the present invention, the reference driving signal S includes an even-number of injection pulses of four or more during one liquid drop injection period. More specifically, where N is a natural number, the reference driving signal S includes at least a (2N−1)th pulse, a (2N) th pulse, a (2N+1)th pulse, and a (2N+2)th pulse in a time-series manner. With such an arrangement, a large dot is formed more accurately and reliably. Preferably, a (2X+1)th pulse (X is a natural number) included in the reference driving signal S in a time-series manner is an injection pulse to control the liquid drop speed (hereinafter, referred to as a "liquid drop speed-controlling injection pulse"). The liquid drop speed control injection pulse is a driving pulse started at a timing that is $(n+(1/2))\times Tc$ after the start of an immediately previous injection pulse in a time-series manner (n is a natural number, and Tc is the Helmholtz characteristic vibration period of the pressure chamber 23). One, or two or more, liquid drop speed control injection pulses may be included in one liquid drop injection period. With such an arrangement, for example, each two ink drops may be merged together before landing on the recording paper sheet 5, so that one large dot is formed more accurately and reliably.

Figure 5:
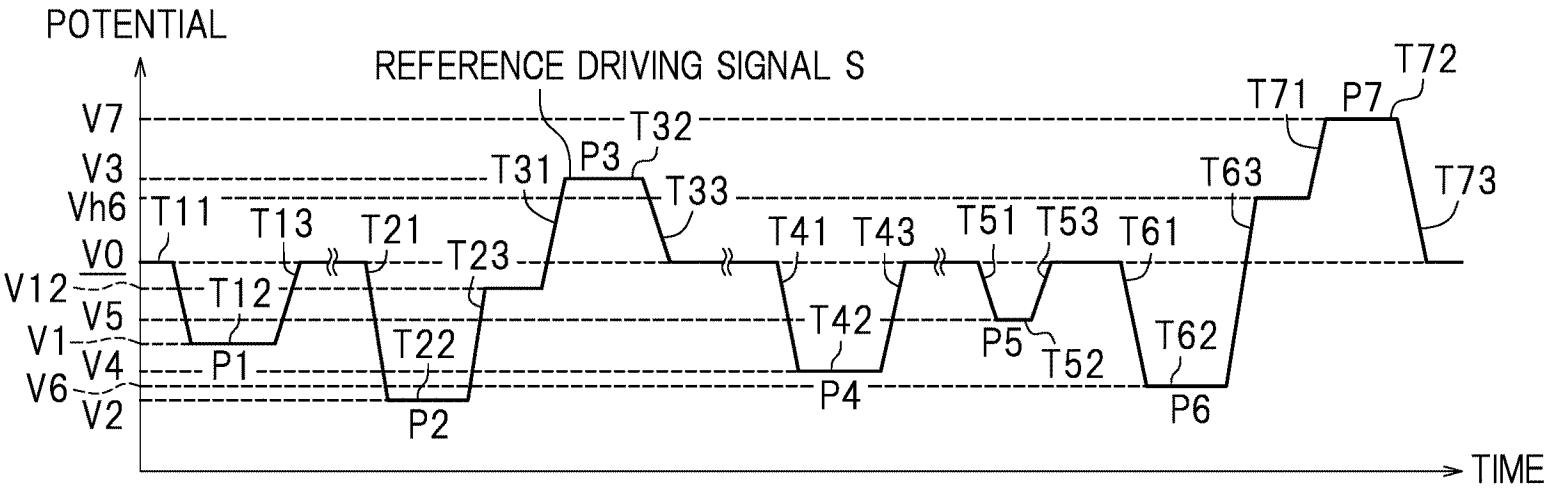
FIG. 5 is a waveform diagram of a reference driving signal according to a preferred embodiment of the present invention.

FIG. 5 is a waveform diagram of a reference driving signal S according to a preferred embodiment of the present invention. The reference driving signal S shown in FIG. 5 is an example of reference driving signal including four injection pulses P1, P2, P4 and P6 in a time-series manner in one liquid drop injection period, with N being 1. The reference driving signal S in this preferred embodiment generates the four injection pulses P1, P2, P4 and P6 sequentially and causes first through four ink drops to be continuously injected from the nozzle 25. As a result, one large dot is formed on the recording paper sheet 5.

The first driving pulse P1 is a trapezoidal waveform including a discharge waveform component T11 by which the potential is decreased from reference potential V0 to first minimum potential V1 at a constant gradient, a discharge maintaining waveform component T12 by which the potential is maintained at the decreased potential (first minimum potential V1) for a predetermined time period, and a charge waveform component T13 by which the potential is increased to the reference potential V0 at a constant gradient. The first injection pulse P1 causes a first ink drop to be injected from the nozzle 25 at a predetermined injection speed S1.

The second driving pulse P2 is a trapezoidal waveform including a discharge waveform component T21 by which the potential is decreased from the reference potential V0 to second minimum potential V2 at a constant gradient, a discharge maintaining waveform component T22 by which the potential is maintained at the decreased potential (second minimum potential V2) for a predetermined time period, and a charge waveform component T23 by which the potential is increased to potential V12 at a constant gradient. The second injection pulse P2 causes a second ink drop to be injected from the nozzle 25 at a predetermined injection speed S2.

The reference driving signal S includes, after the second injection pulse P2 in a time-series manner, a non-injection vibration-controlling pulse P3. The vibration-controlling pulse P3 is a trapezoidal waveform including a charge waveform component T31 by which the potential is increased from the potential V12 to a third maximum potential V3 at a constant gradient, a charge maintaining waveform component T32 by which the potential is maintained at the increased potential (third maximum potential V3) for a predetermined time period, and a discharge waveform component T33 by which the potential is decreased to the reference potential V0 at a constant gradient. The vibration-controlling pulse P3 provides the pressure chamber 23 with an expansion/contraction vibration of a phase opposite to that of the injection pulse P2. Such an expansion/contraction vibration decreases the kinetic energy of the meniscus 25*a* to stabilize the pressure chamber 23.

The third driving pulse P4 is a trapezoidal waveform including a discharge waveform component T41 by which the potential is decreased from the reference potential V0 to a fourth minimum potential V4 at a constant gradient, a discharge maintaining waveform component T42 by which the potential is maintained at the decreased potential (fourth minimum potential V4) for a predetermined time period, and a charge waveform component T43 by which the potential is increased to the reference potential V0 at a constant gradient. The fourth injection pulse P4 causes a third ink drop to be injected from the nozzle 25 at a predetermined injection speed S3.

The reference driving signal S includes, after the third injection pulse P4 in a time-series manner, a non-injection microvibration pulse P5. The microvibration pulse P5 is a trapezoidal waveform including a discharge waveform component T51 by which the potential is decreased from the reference potential V0 to fifth minimum potential V5 at a constant gradient, a discharge maintaining waveform component T52 by which the potential is maintained at the decreased potential (fifth minimum potential V5) for a predetermined time period, and a charge waveform component T53 by which the potential is increased to the reference potential V0 at a constant gradient. While, for example, the ink is not injected, the microvibration pulse P5 may microvibrate the meniscus 25*a* to stir the ink in the pressure chamber 23. This significantly reduces or prevents an inconvenience that, for example, the nozzle 25 is clogged.

The fourth driving pulse P6 is a trapezoidal waveform including a discharge waveform component T61 by which the potential is decreased from the reference potential V0 to sixth minimum potential V6 at a constant gradient, a discharge maintaining waveform component T62 by which the potential is maintained at the decreased potential (sixth minimum potential V6) for a predetermined time period, and a charge waveform component T63 by which the potential is increased to sixth maximum potential Vh6 at a constant gradient. The sixth injection pulse P6 causes a fourth ink drop to be injected from the nozzle 25 at a predetermined injection speed S4.

The reference driving signal S includes, after the fourth injection pulse P6 in a time-series manner, a non-injection vibration-controlling pulse P7. The vibration-controlling pulse P7 is a trapezoidal waveform including a charge waveform component T71 by which the potential is increased from the sixth maximum potential Vh6 to seventh maximum potential V7 at a constant gradient, a charge maintaining waveform component T72 by which the potential is maintained at the increased potential (seventh maximum potential V7) for a predetermined time period, and a discharge waveform component T73 by which the potential is decreased to the reference potential V0 at a constant gradient. The vibration-controlling pulse P7 provides the pressure chamber 23 with an expansion/contraction vibration of a phase opposite to that of the injection pulse P6. Such an expansion/contraction vibration decreases the kinetic energy of the meniscus 25*a* to stabilize the pressure chamber 23.

The timing to start each of the first through fourth injection pulses P1, P2, P4 and P6 shown in FIG. 5 is set as follows. The second injection pulse P2 is started at timing ΔT1, which is m×Tc after the start of the first injection pulse P1 (m is a natural number). ΔT1 is synchronized to the Helmholtz characteristic vibration period Tc of the pressure chamber 23, so that the ink injection is stabilized. The value of m is preferably m≤2, for example, m=1. In this specification, "m×Tc" is a value in the range represented by, for example, m×Tc−(⅙)×Tc to m×Tc+(⅙)×Tc.

The third injection pulse P4 is started at timing ΔT2, which is (n+(½))×Tc after the start of the second injection pulse P2 (n is a natural number). Namely, in this preferred embodiment, the third injection pulse P4 in a time-series manner is a liquid drop speed control injection pulse. ΔT2 is set to (n+(½))×Tc, so that the expansion/contraction vibration of the pressure chamber 23 is controlled. As a result, the injection speed S3 of the third ink drop is reduced and thus the third ink drop is injected while being separated from the first and second ink drops. Therefore, the ink drop is prevented from being excessively large and thus is prevented from being attached to an area in the vicinity of the opening of the nozzle 25. In addition, the meniscus 25*a* is stabilized to prevent an inconvenient that the track of the ink drop is shifted from the proper track. Therefore, the injection stability is improved in a preferable manner. The value of n is preferably $n \leq 5$, and is more preferably $n \leq 3$, for example, $n=2$. In this specification, "n×Tc" is a value in the range represented by, for example, $n \times Tc-(1/6) \times Tc$ to $n \times Tc+(1/6) \times Tc$.

The fourth injection pulse P6 is started at timing ΔT3, which is p×Tc after the start of the third injection pulse P4 (p is a natural number of 2 or greater). With such an arrangement, the fourth ink drop is injected in a state where the meniscus 25*a* is recovered toward the opening of the nozzle 25 at least by a predetermined degree. Therefore, the liquid amount of the fourth ink drop is increased. The value of p is preferably $p \leq 3$, for example, $p=2$. In this specification, "p×Tc" is a value in the range represented by, for example, $p \times Tc-(1/8) \times Tc$ to $p \times Tc+(1/8) \times Tc$, preferably $p \times Tc-(1/10) \times Tc$ to $p \times Tc+(1/10) \times Tc$.

The driving voltage of each of the first through fourth injection pulses P1, P2, P4 and P6 shown in FIG. 5, namely, the change amount of the potential between the reference portion V0 to each of the minimum potentials (potential difference), is set as follows. Driving voltage ΔV2 of the second injection pulse P2 is greater than, or equal to, driving voltage ΔV1 of the first injection pulse P1. In other words, ΔV1 and ΔV2 have the relationship of $\Delta V1 \leq \Delta V2$. From the point of view of reducing the vibration of the meniscus 25*a* to be small, ΔV1 and ΔV2 may have the relationship of $\Delta V1 \leq \Delta V2 \leq 3 \times \Delta V1$, for example, $\Delta V1 \leq \Delta V2 \leq 2 \times \Delta V1$.

Driving voltage ΔV4 of the fourth injection pulse P6 is greater than, or equal to, driving voltage ΔV3 of the third injection pulse P4. In other words, ΔV3 and ΔV4 have the relationship of ΔV3 ΔV4. From the point of view of suppressing the vibration of the meniscus 25*a* small, ΔV3 and ΔV4 may have the relationship of $\Delta V3 \leq \Delta V4 \leq 3 \times \Delta V3$, for example, $\Delta V3 \leq \Delta V4 \leq 2 \times \Delta V3$. The driving voltage ΔV3 of the third driving pulse P4 may be greater than the driving voltage ΔV1 of the first driving pulse P1 and may be approximately 1.3 times of V1 or less. Namely, ΔV1 and ΔV3 may satisfy the relationship of $\Delta V1 < \Delta V3 \leq 1.3 \times \Delta V1$.

From the above-described relationships between the driving voltages, in this preferred embodiment, the injection speed S2 of the second ink drop is greater than the injection speed S1 of the first ink drop, and the injection speed S4 of the fourth ink drop is greater than the injection speed S3 of the third ink drop. Namely, $S1 < S2$, and $S3 < S4$. The injection speed S4 of the fourth ink drop is greater than the injection speed S2 of the second ink drop. Namely, $S2 < S4$. Therefore, in this preferred embodiment, the second ink drop is merged with the first ink drop, and the fourth ink drop is merged with the third ink drop. First, the merged ink drop of the first ink drop and the second ink drop lands on the recording paper sheet 5, and then the merged ink drop of the third ink drop and the fourth ink drop lands on the recording paper sheet 5, at the same position as the merged ink drop, already landed, of the first ink drop and the second ink drop. As a result, a large dot is formed on the recording paper sheet 5.

The discharge time period, namely, the sum of the time period in which the piezoelectric element 26 is discharged and the time period in which the potential thereof is maintained at the decreased potential, of each of the first through fourth injection pulses P1, P2, P4 and P6 shown in FIG. 5 is set as follows. The discharge time period (i.e., the sum of the time period in which the piezoelectric element 26 is discharged and the time period in which the potential thereof is maintained at the decreased potential) t1 of the first injection pulse P1, the discharge time period t2 of the second injection pulse P2, the discharge time period t3 of the third injection pulse P4, and the discharge time period t4 of the fourth injection pulse P6 are each about ½ of the Helmholtz characteristic vibration period Tc of the ink injection head 15. Such an arrangement increases the amplitude of the Helmholtz characteristic vibration of the pressure chamber 23. As a result, the injection stability is improved, and a large ink drop is injected efficiently by a small driving voltage. In this preferred embodiment, the discharge waveform components T11, T21, T41 and T61 of the first through fourth injection pulses have an equal or substantially equal time period in which the potential is discharged. The discharge maintaining waveform components T12, T22, T42 and T62 of the first through fourth injection pulses have an equal or substantially equal time period in which the potential is maintained at the decreased potential.

Now, generation of a supply signal will be described. The driving signal storage circuit 30 has, for example, the reference driving signal S shown in FIG. 5 stored thereon. The timings to start the injection pulses, and the driving voltages, the discharge time periods and the like of the injection pulses shown in FIG. 5 are examples. The reference driving signal S shown in FIG. 5 includes the non-injection vibration-controlling pulses P3 and P7 for the purpose of stabilizing the meniscus 25*a* in the ink injection head 15. The reference driving signal S does not need to include, for example, the vibration-controlling pulse P3. The reference driving signal S shown in FIG. 5 includes the non-injection microvibration pulse P5 for the purpose of micro-vibrating the meniscus 25*a* while an ink drop is not injected. The reference driving signal S does not need to include the non-injection microvibration pulse P5.

The temperature detection circuit 41 of the correction coefficient calculation circuit 40 controls the thermistor 28 to detect the temperature of the ink. The temperature of the ink detected by the temperature detection circuit 41 is input to the main calculation circuit 42. The main calculation circuit 42 calculates a temperature correction coefficient based on the temperature of the ink, such that the size of the dot formed on the recording paper sheet 5 is not influenced by a change in the temperature of the ink. Namely, the temperature correction coefficient is calculated such that the liquid amount (volume) of the ink contained in the ink is constant in a wide temperature range. The temperature correction coefficient may be calculated by a well-known calculation method, which will not be described herein. In general, when the temperature of the ink is low, the ink has a high viscosity and a low fluidity. Therefore, the temperature correction coefficient is a value with which the potential difference of a waveform of an injection pulse (driving voltage) of the reference driving signal S is increased to increase the expansion/contraction of the pressure chamber 23. By contrast, when the temperature of the ink is high, the ink has a low viscosity and a high fluidity. Therefore, the temperature correction coefficient is a value with which the potential difference of a waveform of an injection pulse (driving voltage) of the reference driving signal S is decreased to decrease the expansion/contraction of the pressure chamber 23. The temperature correction coefficient is may be common in all the ink cartridges 11, or may be different by, for example, color.

The reference driving signal S stored on the driving signal storage circuit 30 is input to the driving signal correction circuit 50. The temperature of the ink detected by the temperature detection circuit 41 of the correction coefficient calculation circuit 40, and the temperature correction coefficient calculated by the main calculation circuit 42, are input to the driving signal correction circuit 50. The determination circuit 51 of the driving signal correction circuit 50 determines whether the temperature of the ink detected by the temperature detection circuit 41 is no higher than the reference temperature. The reference temperature is predefined based on, for example, the temperature of the environment in which the printer 10 is installed, the position of the thermistor 28, the viscosity of the ink contained in the ink cartridge 11 or the like. The reference temperature is, for example, about 20° C. to about 30° C., more specifically, about 28° C., for example.

In the case where the determination circuit 41 determines that the temperature of the ink is lower than, or equal to, the reference temperature, the first correction circuit 52 of the driving signal correction circuit 50 corrects a portion of the injection pulses included in the reference driving signal S with the temperature correction coefficient. Specifically, a portion of the injection pulses included in the reference driving signal S is corrected such that the potential difference is increased. By contrast, the potential difference of the liquid drop speed control injection pulse is not corrected and is kept as it is in the reference driving signal S. As a result, the meniscus 25*a* is stabilized, and the injection stability is increased at the time of formation of a large dot. The maximum potential (or minimum potential) of a non-injection driving pulse (e.g., vibration-controlling pulse or microvibration pulse) may be corrected with the temperature correction coefficient or may not be corrected.

The first correction circuit 51 does not correct the liquid drop speed control injection pulse. Therefore, in order to maintain the liquid amount of the ink contained in one dot even in a low-temperature environment (e.g., 15° C. or higher and 28° C. or less), typically, the driving voltage of an injection pulse to be corrected needs to be made higher than the value obtained as a result of the correction performed with the temperature correction coefficient. The reference driving signal obtained as a result of the correction is output as the post-correction driving signal Ss to the driving signal supply circuit 60.

Figure 6A:
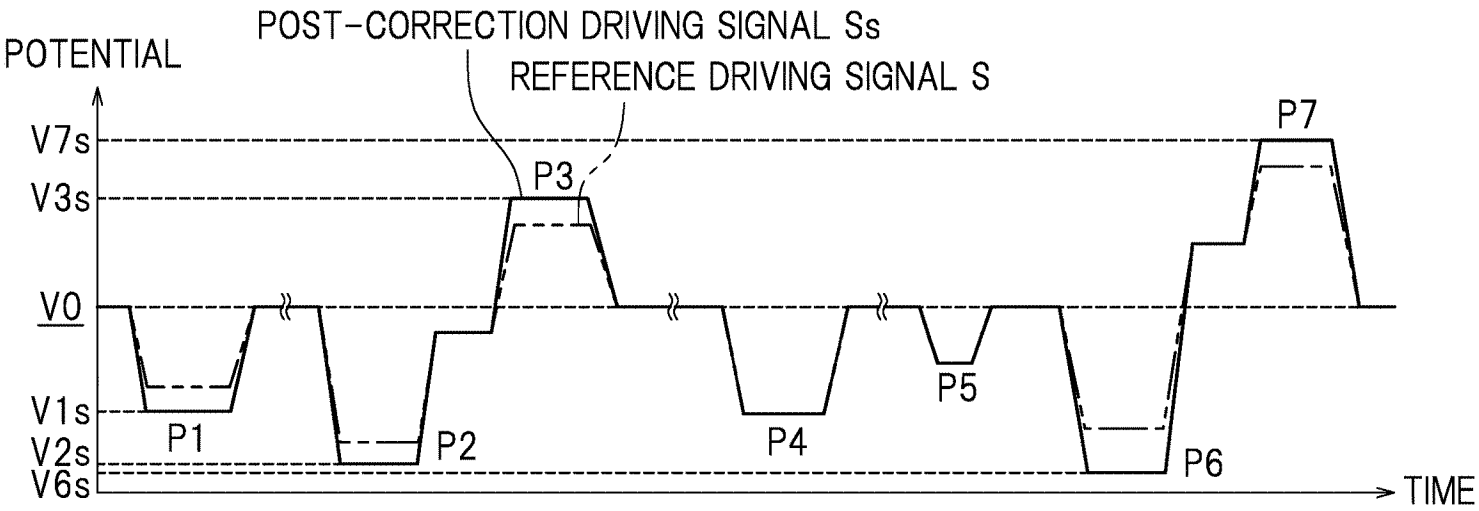
FIG. 6A is a waveform diagram of a post-correction driving signal according to a preferred embodiment of the present invention.

FIG. 6A shows an example of the post-correction driving signal Ss output from the first correction circuit 52. As shown in FIG. 6A, in the post-correction driving signal Ss, the third injection pulse P4, which is a liquid drop speed control injection pulse, has the same waveform as that in the reference driving signal S. By contrast, the injection pulses other than the third injection pulse P4, namely, the first, second and fourth injection pulses P1, P2 and P6, have been corrected with the temperature correction coefficient. As a result, driving voltages $\Delta V1s$, $\Delta V2s$ and $\Delta V6s$ included in the post-correction driving signal Ss are respectively higher than the driving voltages $\Delta V1$, $\Delta V2$ and $\Delta V6$ included in the reference driving signal S. Herein, the term "high" indicates that the absolute value of the difference from reference potential $\Delta 0$ is large. This is also applicable to the following description.

The above-described correction is preferably performed such that the driving voltages of the first through fourth injection pulses included in the post-correction driving signal Ss, namely, the driving voltage $\Delta V1s$ of the first injection pulse P1, the driving voltage $\Delta V2s$ of the second injection pulse P2, driving voltage $\Delta V3s$ of the third injection pulse P4, and the driving voltage $\Delta V4s$ of the fourth injection pulse P6 satisfy the relationships of $\Delta V1s \leq \Delta V2s$ and $\Delta V1s \leq \Delta V3s \leq \Delta V4s \leq 1.5 \times \Delta V1s$. With such a correction, the third ink drop and the fourth ink drop land on the recording paper sheet 5, at the same position as the merged ink drop of the first ink drop and the second ink drop with high precision, while being separated from the merged ink drop of the first ink drop and the second ink drop. In addition, although the amount of the third ink drop is decreased because the temperature of the liquid drop speed control injection pulse P4 is not corrected, such decrease is compensated for in a preferable manner. Therefore, a dot of a predetermined size is formed accurately and reliably in a wide temperature range.

In the case where the determination circuit 51 determines that the temperature of the ink is higher than the reference temperature, the second correction circuit 53 of the driving signal correction circuit 50 corrects all the injection pulses included in the reference driving signal S with the temperature correction coefficient. Specifically, all the injection pulses included in the reference driving signal S are corrected such that the driving voltages thereof are decreased. As a result, a dot of a predetermined size is formed accurately and reliably even in a high-temperature environment (e.g., about 28° C. or higher and about 40° C. or less). The maximum potential (or minimum potential) of a non-injection driving pulse (e.g., vibration-controlling pulse or microvibration pulse) may be corrected with the temperature correction coefficient or may not be corrected. The corrected reference driving signal is output as the post-correction driving signal Ss to the driving signal supply circuit 60.

Figure 6B:
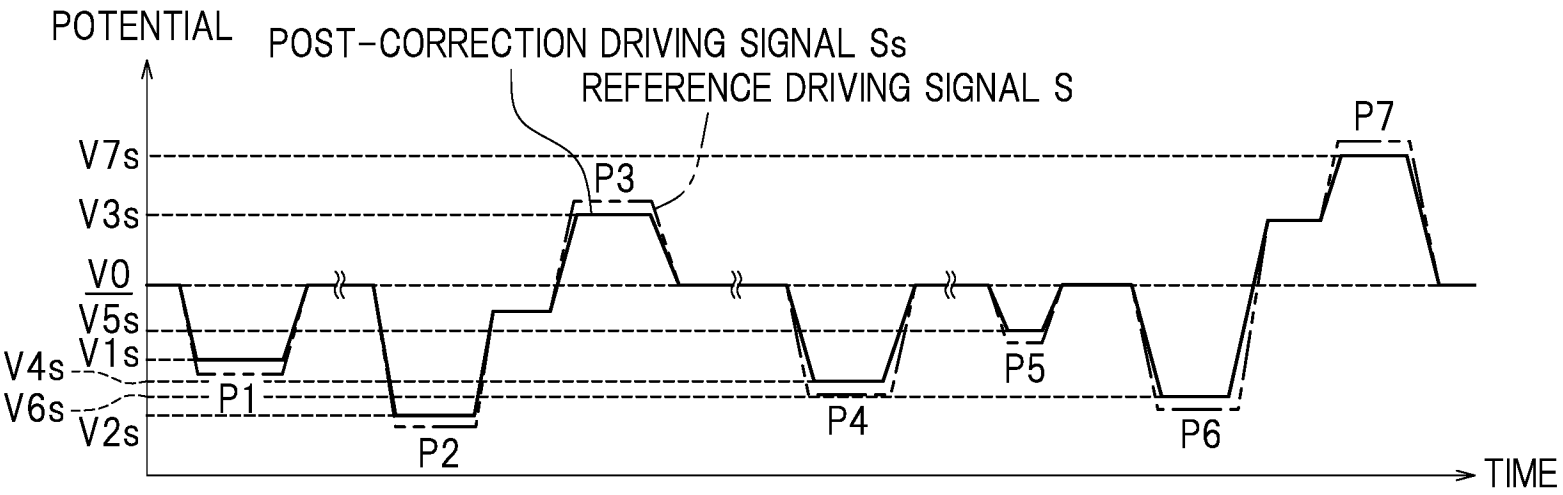
FIG. 6B is a waveform diagram of a supply signal according to a preferred embodiment according of the present invention.

FIG. 6B shows an example of the post-correction driving signal Ss output from the second correction circuit 53. As shown in FIG. 6B, the first through fourth injection pulses P1, P2, P4 and P6 in the post-correction driving signal Ss have been corrected with the temperature correction coefficient. As a result, the driving voltages $\Delta V1s$, $\Delta V2s$, $\Delta V4s$ and $\Delta V6s$ included in the post-correction driving signal Ss are respectively lower than the driving voltages $\Delta V1$, $\Delta V2$, $\Delta V4$ and $\Delta V6$ included in the reference driving signal S. In this preferred embodiment, maximum potentials V3*s*, V7*s* and V5*s* of the non-injection vibration-controlling pulses P3 and P7 and the microvibration pulse P5 are respectively lower than V3, V7 and V5 included in the reference driving signal S.

The above-described correction is preferably performed such that the driving voltages of the first through fourth injection pulses included in the post-correction driving signal Ss, namely, the driving voltage $\Delta V1s$ of the first injection pulse P1, the driving voltage $\Delta V2s$ of the second injection pulse P2, the driving voltage $\Delta V3s$ of the third injection pulse P4, and the driving voltage $\Delta V4s$ of the fourth injection pulse P6 satisfy the relationships of $\Delta V1s \leq \Delta V2s$ and $\Delta V1s < \Delta V3s \leq \Delta V4s \leq 1.3 \times \Delta V1s$. With such a correction, the third ink drop and the fourth ink drop land on the recording paper sheet 5, at the same position as the merged ink drop of the first ink drop and the second ink drop with high precision, while being separated from the merged ink drop of the first ink drop and the second ink drop.

The post-correction driving signal Ss is input to the driving signal supply circuit 60 from the driving signal correction circuit 50. Printing data is input from the storage medium in the controller 18 to the driving signal supply circuit 60. The driving signal supply circuit 60 determines whether or not to form a dot based on the printing data, and when determining that a dot is to be formed, determines the size of the dot. The driving signal supply circuit 60 then selects a portion of the driving pulses from the post-correction driving signal Ss to generate a supply signal. For example, in the case where no dot is to be formed, the driving signal supply circuit 60 selects only the non-injection microvibration pulse P5 to generate a supply signal. By contrast, in the case where a dot is to be formed, the driving signal supply circuit 60 selects a portion of, or all of, the injection pulses P1, P2, P4 and P6 and the non-injection vibration-controlling pulses P3 and P7 to generate a supply signal. Appropriate driving pulses are selected, so that a supply signal to form a dot of any of various sizes, for example, a large dot, a medium dot or a small dot is generated.

Now, an operation of the printer 10 will be described. When the printer 10 is started by a user, the controller 18 performs a preparation to start printing. Specifically, printing data and various types of data representing the characteristics of the ink injection head 15 (e.g., the Helmholtz characteristic vibration period Tc) are read from the controller 18. The controller 18 also decreases the potential of the piezoelectric element 26 to the reference potential V0 to expand the pressure chamber 23 microscopically. The ink injection head 15 waits in this state until a driving signal is transmitted thereto from the controller 18.

When the user instructs the printer 10 to perform a printing operation, the controller 18 drives the feed motor of the paper feeding mechanism. As a result, the recording paper sheet 5 is transported to be located at a predetermined printing position. The controller 18 drives the carriage motor 8*a* of the carriage moving mechanism 8. The controller 18 drives the ink injection head 15 while moving the carriage 1 in the scanning direction (left-right direction in FIG. 1). In more detail, the controller 18 supplies a portion of, or all of, the driving pulses included in the post-correction driving signal Ss as an electric signal to the piezoelectric element 26 of the ink injection head 15. This causes the piezoelectric element 26 to be extended or contracted in accordance with the post-correction driving pulse Ss, which changes the pressure in the pressure chamber 23. As a result, an ink drop having a predetermined mass is injected from the nozzle 25 at a predetermined speed. The injected ink drop lands on the recording paper sheet 5 to form one dot. For example, when printing is performed at a driving frequency of about 21.0 kH and a scanning speed of the carriage 1 of about 1185 mm/s, a large dot of about 20 ng/dot is obtained. When one row of printing is performed as a result of such an operation being repeated, the feed motor of the paper feeding mechanism is driven and the recording paper sheet 5 is located at the next printing position. The printer 10 repeats such an operation to perform predetermined printing. When there is no input of an electric signal to the piezoelectric element 26 anymore, the controller 18 sets the potential of the piezoelectric element 26 to zero.

As described above, the printer 10 in this preferred embodiment includes the first correction circuit 52 and the second correction circuit 53. In the case where the temperature of the ink detected by the temperature detection circuit 41 is lower than, or equal to, the reference temperature, the first correction circuit 52 corrects the injection pulses other than the liquid drop speed control injection pulse P4, namely, the three injection pulses P1, P2 and P6. In the case where the temperature of the ink is higher than the reference temperature, the second correction circuit 53 corrects all the four injection pulses P1, P2, P4 and P6. With such an arrangement, even when the temperature of the ink is low, the injection stability is improved, and thus a dot of a predetermined size is formed with high precision in a wide temperature range from a low temperature to a high temperature.

In this preferred embodiment, the reference driving signal S includes four injection pulses, more specifically, first through fourth injection pulses P1, P2, P4 and P6, and the third injection pulse P4 in a time-series manner is a liquid drop speed control injection pulse. With such an arrangement, the injection speed S3 of the third ink drop is reduced, so that the third ink drop is injected while being separated from the first and second ink drops. This further improves the injection stability.

In this preferred embodiment, the second ink drop is injected at a higher speed than that of the first ink drop, and the fourth ink drop is injected at a higher speed than that of the third ink drop. With such an arrangement, the second ink drop is merged with the first ink drop to form a merged drop, and the fourth ink drop is merged with the third ink drop to form a merged drop. These two merged drops form one large dot on the recording paper sheet 5 accurately and reliably.

In this preferred embodiment, the reference driving signal S is formed such that the driving voltage $\Delta V1$ of the first injection pulse P1, the driving voltage $\Delta V2$ of the second injection pulse P2, the driving voltage $\Delta V3$ of the third injection pulse P4, and the driving voltage $\Delta V4$ of the fourth injection pulse P6 satisfy the relationships of $\Delta V1 \leq \Delta V2$ and $\Delta V1 < \Delta V3 \leq \Delta V4 \leq 1.3 \times \Delta V1$. This further improves the injection stability.

In this preferred embodiment, the first correction circuit 52 corrects the injection pulses such that the driving voltages of the first through fourth injection pulses to be supplied to the piezoelectric element 26, more specifically, the driving voltage $\Delta V1s$ of the first injection pulse P1, the driving voltage $\Delta V2s$ of the second injection pulse P2, the driving voltage $\Delta V3s$ of the third injection pulse P4, and the driving voltage $\Delta V4s$ of the fourth injection pulse P6 satisfy the relationships of $\Delta V1s \leq \Delta V2s$ and $\Delta V1s \leq \Delta V3s \leq \Delta V4s \leq 1.5 \times \Delta V1s$. This further improves the injection stability.

In this preferred embodiment, the second correction circuit 53 corrects the injection pulses such that the driving voltages of the first through fourth injection pulses to be supplied to the piezoelectric element 26, more specifically, the driving voltage $\Delta V1s$ of the first injection pulse P1, the driving voltage $\Delta V2s$ of the second injection pulse P2, the driving voltage $\Delta V3s$ of the third injection pulse P4, and the driving voltage $\Delta V4s$ of the fourth injection pulse P6 satisfy the relationships of relationships of $\Delta V1s \leq \Delta V2s$ and $\Delta V1s < \Delta V3s \leq \Delta V4s \leq 1.3 \times \Delta V1s$. This further improves the injection stability, and allows a large dot to be formed accurately and reliably.

Preferred embodiments of the present invention have been described. The above preferred embodiments are merely examples, and the present invention may be carried out in any of various other forms.

In the above-described preferred embodiments, the pressure generator preferably includes the piezoelectric element 26 operative in a longitudinal vibration mode. The pressure generator is not limited to this, and may be a piezoelectric element of a transverse vibration mode. The pressure generator is not limited to a piezoelectric element and may be, for example, a magnetostrictive element or the like.

In the above-described preferred embodiments, any of the ink injection heads 15 does not include a temperature adjusting function. Alternatively, the ink injection heads 15 may each include a temperature adjuster such as, for example, a heater or the like in order to keep the temperature or the viscosity of the ink in a predetermined range.

In the above-described preferred embodiments, the liquid is ink. The liquid injected by the liquid injection device is not limited to ink, and may be, for example, a resin material, any of various liquid compositions containing a solute and a solvent (e.g., washing liquid, etc.), or the like.

In the above-described preferred embodiments, the injection head of the liquid is the ink injection head 15 mounted on the inkjet recording device. The injection head of the liquid is not limited to this, and may be mounted on, for example, any of various production devices and measuring devices such as a micropipette and the like using an inkjet system and may be usable for any of various applications.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principles of the present invention. These preferred embodiments are provided with the understanding that they are not intended to limit the present invention to the preferred embodiments described in the specification and/or shown in the drawings. The present invention encompasses any of preferred embodiments including equivalent elements, modifications, deletions, combinations, improvements and/or alterations. The elements of each claim should be interpreted broadly based on the terms used in the claim, and should not be limited to any of the preferred embodiments described in this specification or referred to during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A liquid injection device, comprising:

a hollow case accommodating a pressure chamber storing a liquid;

a vibration plate provided in the case and demarcating a portion of the pressure chamber;

a pressure generator coupled with the vibration plate, the pressure generator expanding or contracting the pressure chamber upon receipt of an electric signal;

a nozzle provided in the case and in communication with the pressure chamber;

a temperature sensor detecting a temperature of the liquid;

a driving signal storage circuit storing a reference driving signal including at least four injection pulses, causing the liquid to be injected from the nozzle, in one liquid drop injection period;

a correction coefficient calculation circuit calculating a temperature correction coefficient based on the temperature detected by the temperature sensor;

a driving signal correction circuit correcting the reference driving signal with the temperature correction coefficient; and a driving signal supply circuit supplying the reference driving signal corrected by the driving signal correction circuit to the pressure generator; wherein the at least four injection pulses included in the reference driving signal include a liquid drop injection speed-controlling injection pulse started at a timing that is about (n+(½))×Tc after start of an immediately previous injection pulse in a time-series manner, where n is a natural number, and Tc is a Helmholtz characteristic vibration period of the pressure chamber; and the driving signal correction circuit includes:

a first correction circuit correcting the injection pulses excluding the liquid drop injection speed-controlling injection pulse among the at least four injection pulses when the temperature detected by the temperature sensor is lower than or equal to a predetermined reference temperature; and a second correction circuit correcting all of the at least four injection pulses when the temperature detected by the temperature sensor is higher than the predetermined reference temperature.

2. The liquid injection device according to claim 1, wherein the reference driving signal includes an even number of the injection pulses, and the liquid drop injection speed-controlling injection pulse is a (2X+1)th injection pulse in a time-series manner, where X is a natural number.

3. The liquid injection device according to claim 1, wherein where N is a natural number, the at least four pulses included in the reference driving signal include, in a time-series manner, at least a (2N−1)th injection pulse causing a (2N−1)th liquid drop to be injected, a (2N)th injection pulse causing a (2N)th liquid drop to be injected, a (2N+1)th injection pulse causing a (2N+1)th liquid drop to be injected, and a (2N+2)th injection pulse causing a (2N+2)th liquid drop to be injected; and the reference driving signal causes the (2N)th liquid drop to be injected at a higher speed than that of the (2N−1)th liquid drop, and causes the (2N+2)th liquid drop to be injected at a higher speed than that of the (2N+1)th liquid drop.

4. The liquid injection device according to claim 3, wherein the reference driving signal causes a driving voltage $\Delta V_{(2N-1)}$ of the (2N−1)th injection pulse, a driving voltage $\Delta V_{(2N)}$ of the (2N)th injection pulse, a driving voltage $\Delta V_{(2N+1)}$ of the (2N+1)th injection pulse and a driving voltage $\Delta V_{(2N+2)}$ of the (2N+2)th injection pulse satisfy (1) and (2) to satisfy:

$$\Delta V_{(2N-1)} \leq \Delta V_{(2N)} \quad (1);$$

$$\Delta V_{(2N-1)} < \Delta V_{(2N+1)} \leq \Delta V_{(2N+2)} \leq 1.3 \times \Delta V_{(2N-1)} \quad (2).$$

5. The liquid injection device according to claim 3, wherein the first correction circuit performs correction such that a driving voltage $\Delta V_{(2N-1)s}$ of the (2N−1)th injection pulse supplied to the pressure generator, a driving voltage $\Delta V_{(2N)s}$ of the (2N)th injection pulse supplied to the pressure generator, a driving voltage $\Delta V_{(2N+1)s}$ of the (2N+1)th injection pulse supplied to the pressure generator, and a driving voltage $\Delta V_{(2N+2)s}$ of the (2N+2)th injection pulse supplied to the pressure generator satisfy:

$$\Delta V_{(2N-1)s} \leq \Delta V_{(2N)s} \quad (3);$$

$$\Delta V_{(2N-1)s} \leq \Delta V_{(2N+1)s} \leq \Delta V_{(2N+2)s} \leq 1.5 \times \Delta V_{(2N-1)s} \quad (4).$$

6. The liquid injection device according to claim 3, wherein the second correction circuit performs correction such that a driving voltage $\Delta V_{(2N-1)s}$ of the (2N−1)th injection pulse corrected by the second correction circuit, a driving voltage $\Delta V_{(2N)s}$ of the (2N)th injection pulse corrected by the second correction circuit, a driving voltage $\Delta V_{(2N+1)s}$ of the (2N+1)th injection pulse corrected by the second correction circuit, and a driving voltage $\Delta V_{(2N+2)s}$ of the (2N+2)th injection pulse corrected by the second correction circuit, satisfy:

$$\Delta V_{(2N-1)s} \leq \Delta V_{(2N)s} \quad (3);$$

$$\Delta V_{(2N-1)s} < \Delta V_{(2N+1)s} \leq \Delta V_{(2N+2)s} \leq 1.3 \times \Delta V_{(2N-1)s} \quad (5).$$

7. An inkjet recording device, comprising:

the liquid injection device according to claim 1;

wherein the liquid is ink.

* * * * *